US005223696A

United States Patent [19]

Violi

[11] Patent Number: 5,223,696

[45] Date of Patent: Jun. 29, 1993

[54] STEAM GENERATOR FOR COOKING APPARATUS, WITH AN EMPTYING DEVICE

[75] Inventor: Raymond Violi, Marlens, France

[73] Assignee: Societe Cooperative de Production Bouregois, France

[21] Appl. No.: 673,639

[22] Filed: Mar. 22, 1991

[30] Foreign Application Priority Data

Apr. 4, 1990 [FR] France ..... 90 04608

[51] Int. Cl.[5] ..... F22B 1/28; F22B 29/06

[52] U.S. Cl. ..... 219/401; 392/394; 392/400; 392/482; 122/402

[58] Field of Search ..... 392/394, 400, 402, 403, 392/459, 482, 486, 490, 480, 481, 396, 397, 398; 219/401; 122/402, 397, 379

[56] References Cited

U.S. PATENT DOCUMENTS

| | | | |
|---|---|---|---|
| 1,389,166 | 8/1921 | Scott | 392/480 |
| 1,495,658 | 5/1924 | Wilkinson | 392/482 |
| 1,667,758 | 5/1928 | Welter | 392/401 |
| 1,672,942 | 6/1928 | Isaacs | 392/482 |
| 2,154,021 | 4/1939 | Abbate | 392/482 |
| 2,519,920 | 8/1950 | Miner | 392/480 |
| 3,025,381 | 3/1962 | Pickering | 392/401 |
| 4,107,511 | 8/1978 | Shulz | 219/401 |
| 4,230,536 | 10/1980 | Sech | 392/400 |
| 4,287,407 | 9/1981 | Treiber | 392/400 |
| 4,392,049 | 7/1983 | Bentley | 219/401 |
| 4,924,068 | 5/1990 | Henri . | |
| 4,991,545 | 2/1991 | Rabe | 122/379 |

FOREIGN PATENT DOCUMENTS

| | | |
|---|---|---|
| 280782 | 7/1988 | European Pat. Off. . |
| 317444 | 5/1989 | European Pat. Off. . |
| 383327 | 8/1990 | European Pat. Off. . |
| 8901904 | 7/1989 | Fed. Rep. of Germany . |

*Primary Examiner*—Teresa J. Walberg

[57] ABSTRACT

A steam generator is disclosed for a cooking apparatus, having an intermediate duct admitting discharge water into the lowest central portion of the enclosure of the generator, and connected to a vane pump whose outlet feeds into an outlet duct rising as far as an upper bend then descending as far as an emptying duct. Heating tubes cause vaporization of the water which they contain and the steam escapes through a horizontal upper duct then a steam conduction duct. The generator applies in particular to ovens for cooking food.

8 Claims, 4 Drawing Sheets

STEAM GENERATOR FOR COOKING APPARATUS, WITH AN EMPTYING DEVICE

BACKGROUND OF THE INVENTION

1. Field of the Invention

The present invention relates to devices for producing steam from liquid water, the steam being used more particularly in food cooking apparatus.

2. Description of the Prior Art

Numerous steam generators are known which generally comprise a generator enclosure adapted for containing water, means for feeding water into the enclosure, a steam conduction duct for feeding the steam into a user enclosure and means for heating the water contained in the generator enclosure for bringing the water to boiling point and producing steam.

Thus, the document EP-A-0 323 939 describes such a steam generator comprising a horizontal lower duct, a horizontal upper duct, the two ducts being connected together by one or more parallel vertical heating tubes and by a return tube which is also vertical, a tapping of the return tube being fitted with water level detection means. The water contained in the generator can flow through a lower lateral orifice, closable by means of a valve, for emptying the generator at the end of use.

The Applicants have discovered a tendency to localized heating in such a steam generator, causing for example excessive heating of the heating tubes whereas the other tubes operate correctly at appropriate temperatures.

It appears that the heating problems do not occur at the beginning of operation but occur only after a sufficient operating time.

A thorough study of the problem has shown that the localized heating may be overcome by correctly removing the scale waste which tends to accumulate in the lower part of the steam generator.

Thus, the problem proposed by the invention is to suppress simply, automatically and inexpensively the excessive differential heating appearing on the heating elements of steam generators after an operating time.

The solution must allow the scale appearing at the low part of the steam generator to be sufficiently removed.

A first solution is suggested in the document EP-A-317 444 which describes a steam generator in which the heating means are of a special kind, using porous bodies. The porous heating body is plunged into an enclosure containing water and defined by a lower wall having an orifice discharging into a lower discharge duct closed by a valve. The document suggests removing the particles of scale by opening the lower valve for the flow of water, and simultaneously feeding rinsing water through an upper duct. Such a cleaning procedure requires a complementary volume of rinsing water and means for feeding and controlling the rinsing water flow, which substantially increases the cost of the installation. In addition, such a structure, with a water feed at the upper part of the enclosure would be difficult to apply to a steam generator in which the heating means are vertical tubes, for it would then be necessary to introduce the rinsing water into each of the tubes separately.

Another solution is proposed in the documents DE-U-8 901 904 and EP-A-383 327. In these documents, the heating means are introduced into an enclosure filled with water to an intermediate level. A suction and delivery pump causes the discharge water to flow into an intermediate duct disposed between the pump and the lower wall of the enclosure of the generator. These documents recommend placing the water discharge orifice in the lower enclosure wall close to the lateral wall of the enclosure, and positioning a rinsing water injection nozzle in a diametrically opposite situation. The combination of the pump and the rinsing nozzle produces a violent fluid stream in the tank, for cleaning it. This structure is also complex and expensive, since it requires not only a complementary supply of rinsing water, but also means for feeding the rinsing water, for controlling the rinsing water and a discharge pump. Furthermore, this solution would not be adaptable to cleaning steam generators in which the heating means are vertical tubes: the means described do not allow a fluid stream to be created inside the tubes, since the stream produced is perpendicular to the axis of the heating tubes.

SUMMARY OF THE INVENTION

Thus, the invention overcomes this problem simply and economically by providing a generator having:

an intermediate duct opening at its first end into an orifice in the lower wall of the steam generator enclosure, the intermediate duct being horizontal or descending to its second end, a suction and delivery pump whose input is connected to the second end of the intermediate duct and whose output discharges into an outlet duct extended by a discharge duct, the lower enclosure wall orifice is disposed in the central zone of said wall, said orifice forms the lowest lower wall portion, said lower wall forming a regular flat surface or a surface descending towards said orifice.

This combination of characteristics causes, in the enclosure of the generator, a rapid turbulent stream of water during emptying. Driving of the scale particles is considerably improved, causing a discharge which becomes sufficient for solving the problem of the invention, without requiring an external rinsing water supply.

The pump is advantageously a pump with rotary vanes, rotating about an axis parallel to the second intermediate duct end, and feeding into an outlet duct orifice disposed radially at the periphery of the zone of rotation of the vanes. The rotary vanes are driven by an asynchronous electric motor. Such a type of pump is well adapted for use in the present invention, for it has very great robustness and is insensitive to the risks of clogging. Thus, there is no danger of the scale particles clogging the pump and damaging it.

Preferably, the outlet duct rises from the pump to an upper bend and then descends to the drain duct. With this arrangement, a water passage is permanently left from the enclosure of the steam generator to the drain duct, the pump not preventing the passage of water but simply driving it when it rotates. The result is that the device avoids the appearance of overpressures inside the steam generator, any overpressure causing the water to flow in the direction of the emptying duct. The device is also very reliable, since nothing can oppose discharge of the water contained in the steam generator enclosure. This solution has a further economic advantage, for it is of a particularly low cost, not requiring the use of electrovalves.

The discharge structure according to the present invention may be applied to steam generator types in which the heating means are plunging resistances inserted simply in the enclosure which contains the water. However, the present invention is particularly advantageous when it is applied to a steam generator in which the heating means are vertical heating tubes connecting together a transverse lower duct and a transverse upper duct, with a return tube which is also vertical, the heating tubes being provided with a helically wound electric resistance in contact with the external face of their wall. In fact, in such a structure, the scale tends naturally to be formed in the heating tubes and, following temperature variations, the scale tends to be detached from the walls and fall in the form of powder into the lower duct. The scale is then totally removed by the discharge means of the present invention.

BRIEF DESCRIPTION OF THE DRAWINGS

Other objects, features and advantages of the present invention will be clear from the following description of particular embodiments, with reference to the accompanying figures in which.

DESCRIPTION OF THE PREFERRED EMBODIMENTS

Figure 1:
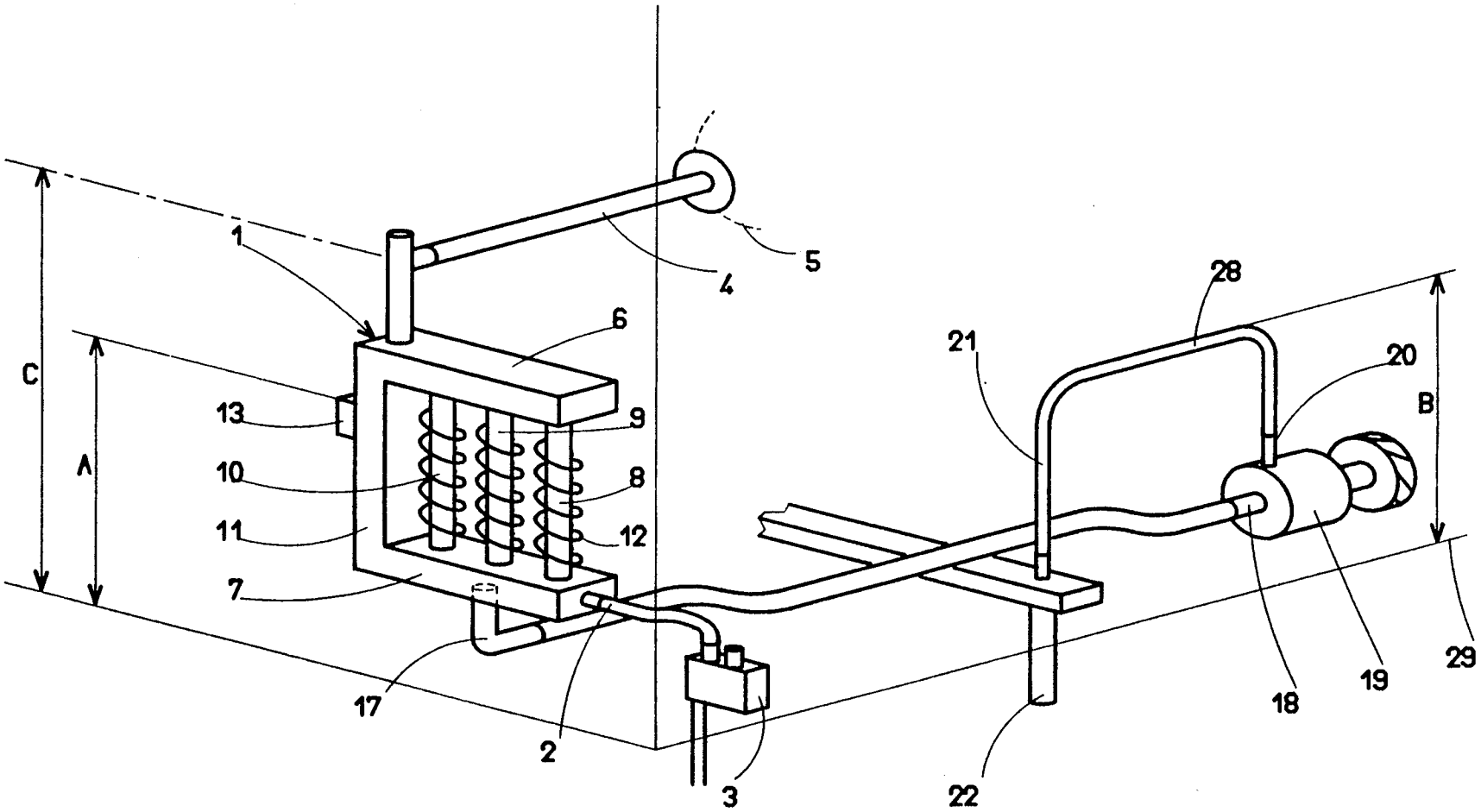
FIG. 1 is a schematic view showing the implantation of the means of the present invention for forming a steam generator adapted for example to an oven for cooking food.
Figure 2:
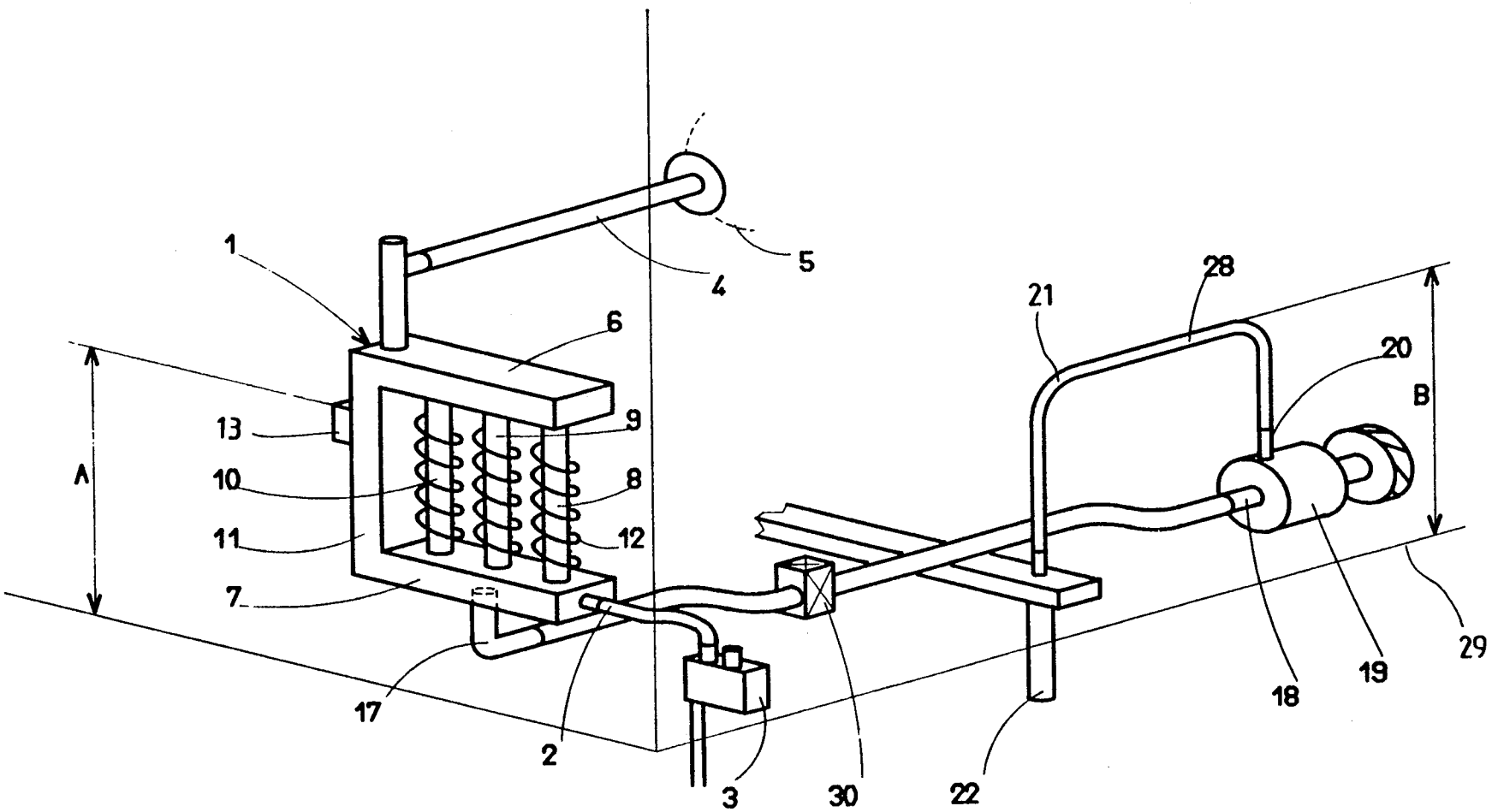
FIG. 2 is a schematic perspective view of another embodiment of the device according to the present invention.

A shown in FIGS. 1 and 2, a steam generator according to the present invention comprises a generator enclosure 1 adapted for containing water. A water feed duct 2, with an electrovalve 3, feeds water into the low part of the enclosure 1 of the generator. The steam is recovered in the upper part of enclosure 1 by means of a steam conduction duct 4 and is brought into a user enclosure shown schematically at 5, for example the enclosure of an oven for cooking food.

In the embodiment shown, enclosure 1 comprises a horizontal upper duct 6, and a horizontal lower duct 7, both being connected together by at least one vertical heating tube, for example three tubes respectively 8, 9 and 10 and by a vertical return tube 11. The heating tubes 8, 9 and 10 are hollow tubes, for example made from metal, carrying electric helically wound resistances such as resistance 12 of tube 8 in contact with the outer face of each tube.

Figure 3:
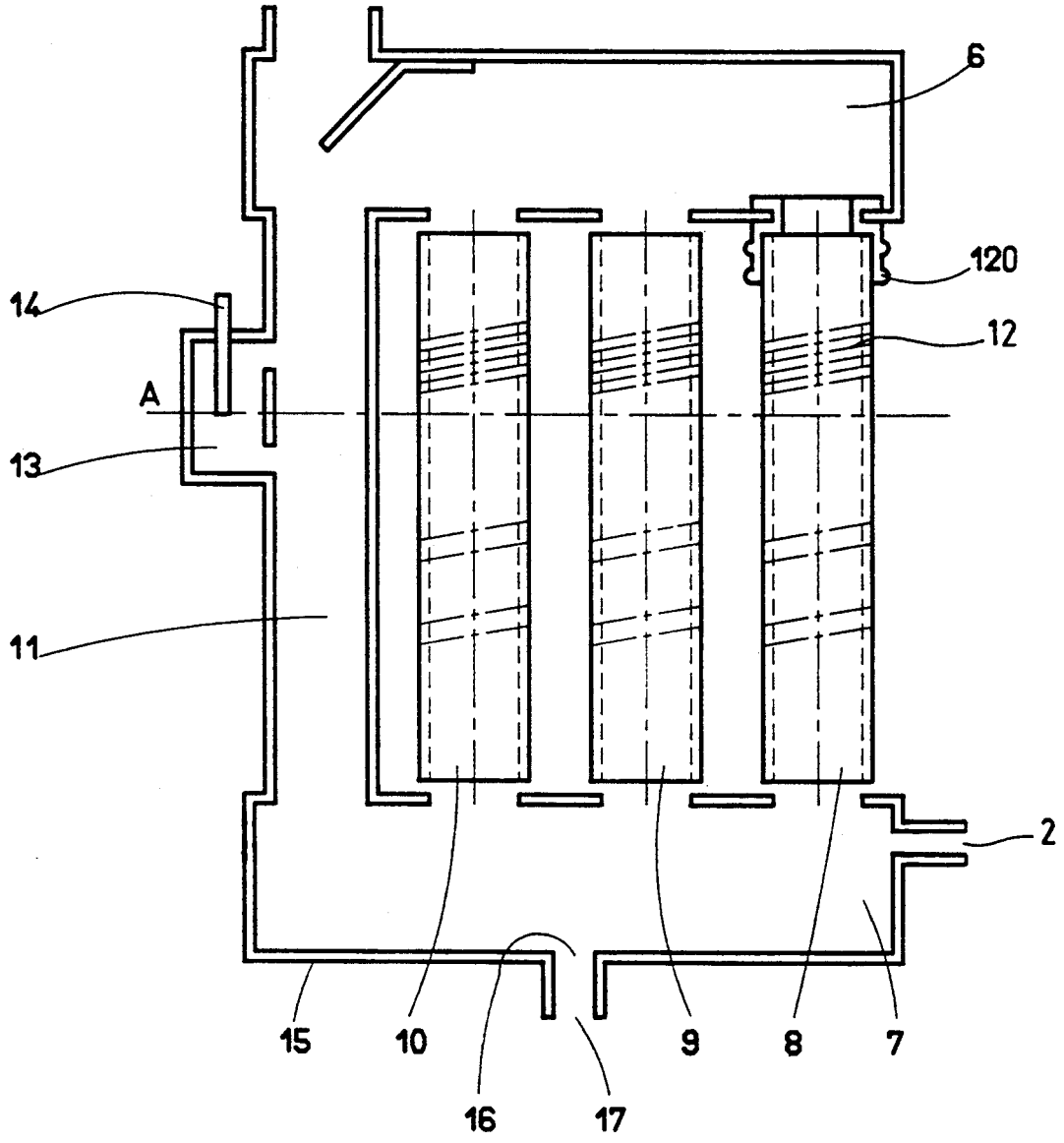
FIG. 3 is a side sectional view of a steam generator enclosure which may be used in the present invention.

As shown in section in FIG. 3, the heating tubes are connected to the upper and lower ducts by flexible connections such as connection 120 which alone has been shown in FIG. 3.

The return tube 11 is fitted with a parallel tapping 13 which comprises water level measuring means A, for example the measuring means comprise a resistive probe 14, whose lower end is at a desired intermediate level A of the water and which delivers an electric signal representative of the presence or absence of water at level A. The electric signal is fed to an electric processing device, not shown in the figures, for controlling valve 3 for the intake of water until level A is reached at which the water enters into contact with probe 14 and for cutting off the supply of water as long as probe 14 indicates the contact of the water on the probe.

The electric resistances such as resistance 12 are designed for heating the walls of tubes 8, 9 and 10 and bringing the water which they contain to boiling point. The steam escapes through the top and penetrates into the horizontal upper duct 6, then escapes through the steam conduction duct 4 as far as the user enclosure 5. The complete operation of this type of generator is described in document EP-A-0 323 939.

According to the present invention, the lower wall 15 of the horizontal lower duct 7 is generally flat and horizontal and comprises an orifice 16 formed in its central part as shown in FIG. 3. Orifice 16 is connected to the first end of an intermediate duct 17 whose second end 18 is connected to the input of a pump 19. The intermediate duct 17 is horizontal or descends from its first end adjacent the lower duct 7 as far as its second end 18 adjacent pump 19. Thus, pump 19 is situated at a lower level than the level of the lower duct 7 of the generator.

Pump 19 is a suction and delivery pump, whose outlet 20 discharges into an outlet duct 21 extended by a drain duct 22.

Figure 4:
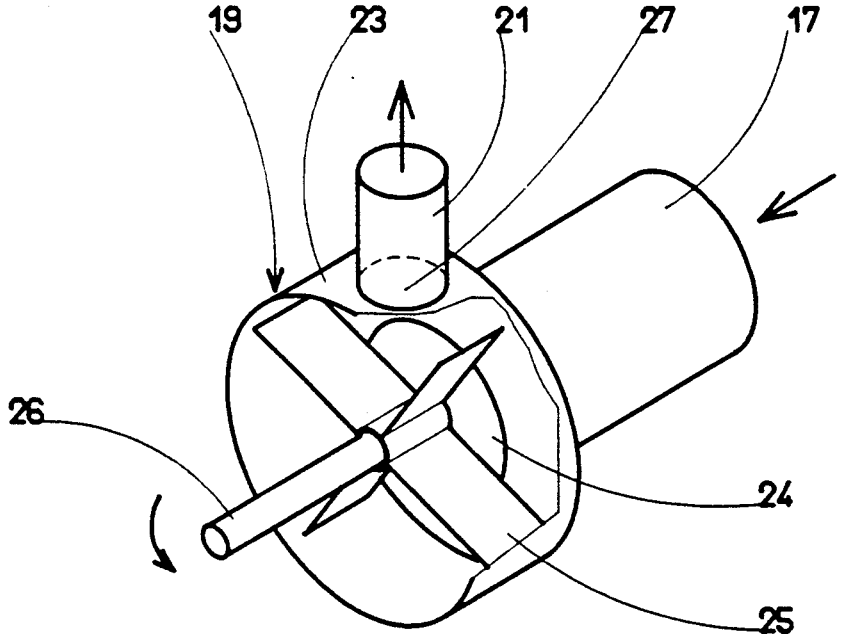
FIG. 4 is a partial sectional schematic view in perspective of a rotary van pump which can be used in the generator of the present invention.

Pump 19 is a rotary vane pump, for example such as shown schematically in FIG. 4 in perspective and in partial section. The intermediate duct 17 opens into a pump enclosure 23 through an axial orifice 24. The pump comprises rotary vanes such as vane 25, mounted for rotation on a drive shaft 26 coaxial with orifice 24 and the adjacent intermediate duct portion 17. The outlet orifice 27 of the pump is disposed radially in the upper part of the enclosure wall 23, as shown in FIG. 4. Rotation of vanes 25 causes water to be driven into the outlet duct 21.

In FIGS. 1 and 2, the outlet duct 21 comprises a portion rising from the outlet 20 of pump 19 as far as an upper bend 28, and a portion going down from the upper bend 28 as far as the drain duct 22.

The level B of the upper bend 28 is set with respect to the base plane 29 of the device, as shown in FIGS. 1 and 2. The level A, which forms with respect to the same base plane 29 the surface of the water contained in the enclosure 1, is set by regulating the electrovalve 3 and probe 14 associated with the electric processing device. Level C of the steam conduction duct 4 is set with respect to the same base plane 29, or at least the maximum level in this duct 4 between the upper duct 6 and the steam user enclosure 5.

In a first embodiment shown in FIG. 1, the steam generator is of the flowing vapor generator type. The water level regulation means maintain, inside enclosure 1, a level close to level A and substantially constant. It is then advantageous to provide a level B of the upper bend 28 of the outlet duct 21 which is higher than level A of the water in the enclosure, but lower than the level C of the steam conduction duct 4. Thus, double safety of the water level is obtained: supposing that the water intake electrovalve 3 remains open despite the level A of water in enclosure 1 being exceeded, the water may then flow freely through the outlet duct 21 into the drain duct 22, the vane pump 19 not opposing the flow of water even when it is not rotating. The maximum water level then exceeds level A, but should not exceed level b of the upper bend 28 of the outlet duct 21. The result is that there is no danger of water flowing through the steam conduction duct 4 into the enclosure 5 of the oven.

By providing a level B of the upper bend 28 of the outlet duct 21 only slightly higher than the normal regulated level A of the water level in enclosure 1, double safety of regulation of the water level in enclosure 1 is obtained, if level B is less than the level of the upper duct 6 of enclosure 1. In fact, assuming an operating defect of valve 3 which might remain open, the water in enclosure 1 should not exceed level B of the upper bend 28, i.e. should remain below the level of the upper duct 6 of the enclosure 1. In this state, the steam generator may still operate correctly and produce steam which is separated from the water in the upper duct 6 and discharged through the steam conduction duct 4.

In the embodiment shown in FIG. 2, an electrovalve 30 is inserted in the intermediate duct 17 and is associated with a control means for controlling its closure during production of steam in the steam generator and for controlling its opening during the draining phase. The other parts of the device are identical to those of the embodiment shown in FIG. 1. In this case the level B of the upper bend 28 may be chosen higher, equal to or less than the normal regulated level A of the water in the enclosure 1. It is however preferable to have an upper bend 28 which avoids the return of liquid which might come from the drain duct 22.

This embodiment with an electrovalve 30 may also be suitable in the case where the steam generator is to produce steam at a pressure greater than the atmospheric pressure.

In normal operation, the device of the present invention is such that the level of the water is maintained substantially constant and at the intermediate height A in the enclosure 1. The electric resistances such as resistance 12 are fed from an external electric energy source and heat tubes 8, 9 and 10 and the water which they contain. This water vaporizes and the steam escapes through the upper duct 6 and the steam conduction duct 4 as far as the steam user enclosure 5. The evaporation of the water causes the water level in enclosure 1 to drop, and when the level becomes less than level A, probe 14 delivers an electric signal causing the electrovalve 3 to open and water to be fed into the horizontal lower duct 7. When the normal level A is again reached, probe 14 produces another electric signal causing electrovalve 3 to close. The device is thus kept operating as long as it is desired to produce steam.

After normal operation, for example at the end of each day, the user initiates the beginning of an emptying step, during which the electric resistances 12 are no longer supplied with power, electrovalve 3 remains closed and pump 19 is fed with electric energy for causing rotation of the rotary vanes 25. In the embodiments comprising an electrovalve 30 in the intermediate duct 17, the electrovalve 30 must then be open to allow water to pass into duct 17. The pump 19 causes rapid turbulent suction of the water contained in enclosure 1 and injection thereof into the emptying duct 22. After total ejecting, rotation of pump 19 is stopped, electrovalve 30 is closed as required and the device is ready for a new intake of water and the production os steam.

In the case of overpressures in the steam generator or in enclosure 5 of the oven, in the embodiment of FIG. 1 without electrovalve 30, the overpressure causes water to be driven through the intermediate duct 17, the outlet duct 21 and the emptying duct 22, thus limiting the overpressure in enclosure 5 and in enclosure 1.

The present invention is not limited to the embodiments which have been explicitly described, but includes the different variants and generalizations thereof contained within the field of the following claims.

What is claimed is:

1. Steam generator comprising a generator enclosure adapted for containing water, means for feeding water into the enclosure, means for heating the water contained in the generator enclosure for bringing the water to boiling point and producing steam, a steam conduction duct for feeding the steam produced into a user enclosure, comprising:

an intermediate duct with a first end and a second end, the intermediate duct opening at its first end into the lower wall of the steam generator enclosure, the intermediate duct being horizontal or descending to its second end, a suction and delivery pump whose input is connected to the second end of the intermediate duct and whose output discharges directly into an outlet duct extended by a discharge duct, wherein:

the first intermediate duct end opens into an orifice disposed in a central zone of the lower wall of the generator enclosure.

said orifice forms the lowest lower wall portion, said lower wall forming a regular flat surface or a surface descending towards said orifice, whereby a rapid turbulent stream of water is created during emptying of the generator enclosure for driving scale particles from the generator enclosure.

2. Steam generator as claimed in claim 1, wherein the pump is a rotary vane pump.

3. A steam generator having a generator enclosure containing water, means for feeding water into the enclosure, means for heating the water in the generator enclosure to the boiling point for producing steam, a steam conduction duct for feeding the steam produced into a user enclosure, comprising:

water level regulation means maintaining a substantially constant water level in the generator enclosure;

an intermediate duct having a first end and a second end;

the first end of the intermediate duct opening into an orifice disposed in a central zone of a lower wall of the generator enclosure, wherein said lower wall forms a regular flat surface or a surface descending towards said orifice, and said orifice forms the lowest lower wall portion;

the intermediate duct being horizontal or descending to its second end;

the intermediate duct includes an electrovalve, means for controlling closure of the electrovalve during the production of steam and means for controlling opening of the electrovalve during emptying of the generator enclosure; and a suction and delivery pump whose input is connected to the second end of the intermediate duct and whose output discharges directly into an outlet duct extended by a discharge duct;

whereby a rapid turbulent stream of water is created during emptying of the generator enclosure for driving scale particles from the generator enclosure.

4. A steam generator having a generator enclosure containing water, means for feeding water into the enclosure, means for heating the water in the generator enclosure to the boiling point for producing steam, a steam conduction duct for feeding the steam produced into a user enclosure, comprising:

an intermediate duct having a first end and a second end;

the first end of the intermediate duct opening into an orifice disposed in a central zone of a lower wall of the generator enclosure, wherein said lower wall forms a regular flat surface or a surface descending towards said orifice, and said orifice forms the lowest lower wall portion;

the intermediate duct being horizontal or descending to its second end; and a suction and delivery pump whose input is connected to the second end of the intermediate duct and whose output discharges into an outlet duct, which rises from the pump as far as an upper bend and then descends from the upper bend to a discharge duct;

whereby a rapid turbulent stream of water is created during emptying of the generator enclosure for driving scale particles from the generator enclosure.

5. Steam generator as claimed in claim 4, wherein:

the steam generator is provided with water level regulation means maintaining a substantially constant water level inside the generator enclosure, an electrovalve is inserted in the intermediate duct, with means for controlling closure of the electrovalve during the production of steam and means for controlling opening of the electrovalve during emptying.

6. Steam generator as claimed in claim 5, wherein:

the enclosure comprises a horizontal upper duct and a horizontal lower duct, said upper and lower ducts being connected together by at least one vertical heating tube and by a vertical return tube, the heating means comprise a helically wound electric resistance in contact with the external face of the heating tube, the flow orifice is formed in the lower wall of the horizontal lower duct.

7. A steam generation device for use with an oven for cooking food comprising:

a steam generator having a generator enclosure containing water and including a horizontal upper duct and a horizontal lower duct having a lower wall, said upper and lower ducts being connected together by at least one vertical heating tube and by a vertical return tube;

a helically wound electric resistance, in contact with the external face of the at least one vertical heating tube, for heating the water in the generator enclosure to the boiling point for producing steam;

means for feeding water into the generator enclosure;

a steam conduction duct for feeding the steam produced into a user enclosure;

water level regulation means maintaining a substantially constant water level in the generator enclosure;

an intermediate duct having a first end and a second end and having an electrovalve, means for controlling closure of the electrovalve during the production of steam and means for controlling opening of the electrovalve during emptying of the generator enclosure, wherein:

(a) the first end of the intermediate duct opens into an orifice disposed in a central zone of the lower wall of the horizontal lower duct of the generator enclosure, and (b) said lower wall forms a regular flat surface or a surface descending towards said orifice, (c) said orifice forms the lowest lower wall portion, and (d) the intermediate duct is horizontal or descends to its second end; and a suction and delivery pump whose input is connected to the second end of the intermediate duct and whose output discharges into an outlet duct, which rises from the pump as far as an upper bend and then descends from the upper bend to a discharge duct;

whereby a rapid turbulent stream of water is created during emptying of the generator enclosure for driving scale particles from the generator enclosure.

8. A steam generator comprising:

a generator enclosure containing water and having a horizontal upper duct and a horizontal lower duct having a lower wall, said upper and lower ducts being connected together by at least one vertical heating tube and by a vertical return tube;

means for feeding water into the enclosure;

means for heating the water contained in the generator enclosure for bringing the water to boiling point for producing steam;

a steam conduction duct for feeding the steam produced into a user enclosure;

an intermediate duct with a first end and a second end;

the intermediate duct opening at its first end into the lower wall of the steam generator enclosure;

the intermediate duct being horizontal or descending to its second end; and a suction and delivery pump whose input is connected to the second end of the intermediate duct and whose output discharges directly into an outlet duct extended by a discharge duct, wherein:

the first intermediate duct end opens into an orifice disposed in a central zone of the lower wall of the generator enclosure, and said orifice forms the lowest lower wall portion, said lower wall forming a regular flat surface or a surface descending towards said orifice, whereby a rapid turbulent stream of water is created during emptying of the generator enclosure for driving scale particles from the generator enclosure.

* * * * *

UNITED STATES PATENT AND TRADEMARK OFFICE

CERTIFICATE OF CORRECTION

PATENT NO. : 5,223,696

DATED : June 29, 1993

INVENTOR(S) : VIOLI

It is certified that error appears in the above—identified patent and that said Letters Patent is hereby corrected as shown below:

On title page, change item

[73] Assignee: Societe Cooperative de Production Bourgeois, France

Signed and Sealed this

Twenty-sixth Day of July, 1994

Attest:

Bruce Lehman

BRUCE LEHMAN

Attesting Officer

Commissioner of Patents and Trademarks